US010062990B1

(12) United States Patent
Hunt et al.

(10) Patent No.: US 10,062,990 B1
(45) Date of Patent: Aug. 28, 2018

(54) CONNECTOR WITH LOCKING TEETH

(71) Applicant: Valeo North America, Inc., Troy, MI (US)

(72) Inventors: Brian Hunt, Columbus, IN (US); Tom Grider, Seymour, IN (US)

(73) Assignee: Valeo North America, Inc., Troy, MI (US)

( * ) Notice: Subject to any disclaimer, the term of this patent is extended or adjusted under 35 U.S.C. 154(b) by 0 days.

(21) Appl. No.: 15/605,510

(22) Filed: May 25, 2017

(51) Int. Cl.
*H01R 13/62* (2006.01)
*H01R 12/72* (2011.01)
*H01R 13/627* (2006.01)

(52) U.S. Cl.
CPC ..... *H01R 12/721* (2013.01); *H01R 13/6273* (2013.01)

(58) Field of Classification Search
CPC ..... H01R 12/87
USPC ..... 439/260, 267, 635, 325, 328
See application file for complete search history.

(56) References Cited

U.S. PATENT DOCUMENTS 3,130,351 A * 4/1964 Giel ..... H05K 7/1452 361/726
3,140,907 A * 7/1964 Davies ..... H01R 13/193 439/59
3,188,598 A * 6/1965 Pferd ..... H01R 12/88 324/756.05
3,594,699 A * 7/1971 Jayne ..... H01R 12/87 439/325
3,710,303 A * 1/1973 Gallager, Jr. ..... H01R 12/87 439/108
3,731,252 A * 5/1973 McKeown ..... H05K 3/308 439/260
3,789,345 A * 1/1974 Reimer ..... H01R 12/87 439/630
3,858,957 A * 1/1975 Harwood ..... H01R 12/82 439/267
3,993,383 A * 11/1976 Marino ..... H01R 12/728 439/59
4,095,791 A * 6/1978 Smith ..... A63F 13/02 200/6 A
4,253,719 A * 3/1981 McGinley ..... H01R 12/721 439/329
4,449,775 A * 5/1984 de Pommery ..... G06K 7/0017 235/441
4,548,456 A * 10/1985 Robertson ..... H01R 12/721 439/267

(Continued)

*Primary Examiner* — Neil Abrams
(74) *Attorney, Agent, or Firm* — Oblon, McClelland, Maier & Neustadt, L.L.P.

(57) ABSTRACT

Described herein is a connector, an electric circuit and a lighting apparatus. The connector includes a connector body having a top edge, a bottom edge and a wall connecting the top edge and the bottom edge, the wall providing flexibility to move the top edge relative to the bottom edge, a plurality of metal contacts embedded within the top edge and the bottom edge, locking teeth projecting from the top edge and the bottom edge, wherein the top edge and the bottom edge move away from each other upon application of a force on the locking teeth. Furthermore, the connector can be connector to a printed circuit board. The printed circuit board includes a plurality of pockets configured to receive the locking teeth of the connector and a plurality of metal strips configured to contact with the plurality of the metal contacts of the connector.

20 Claims, 6 Drawing Sheets

(56) References Cited

U.S. PATENT DOCUMENTS

| | | | | | |
|---|---|---|---|---|---|
| 4,747,794 | A * | 5/1988 | Seidler | H01R 13/193 | 439/295 |
| 4,795,897 | A * | 1/1989 | Chalendard | G06K 7/0021 | 235/482 |
| 5,043,562 | A * | 8/1991 | Hautvast | G06K 13/08 | 235/384 |
| 5,160,275 | A * | 11/1992 | Nakamura | H01R 12/82 | 439/267 |
| 5,295,852 | A * | 3/1994 | Renn | H01R 12/721 | 439/328 |
| 5,389,000 | A | 2/1995 | DiViesti et al. | | |
| 5,823,823 | A * | 10/1998 | Longueville | H01R 12/87 | 439/260 |
| 6,206,713 | B1 * | 3/2001 | Baertsoen | H01R 12/88 | 439/260 |
| 6,663,407 | B1 | 12/2003 | Pickles | | |
| 7,255,586 | B2 * | 8/2007 | Okada | H01R 13/20 | 439/346 |
| 8,298,001 | B2 * | 10/2012 | Ashibu | H01R 12/88 | 439/328 |
| 8,373,816 | B2 | 2/2013 | Kim et al. | | |
| 8,398,423 | B2 * | 3/2013 | Simmel | H01R 12/87 | 439/346 |
| 8,651,885 | B2 * | 2/2014 | Ashibu | H01R 12/774 | 439/328 |
| 8,968,020 | B2 * | 3/2015 | Nishiyama | H01R 13/627 | 439/345 |

* cited by examiner

CONNECTOR WITH LOCKING TEETH

BACKGROUND

Field of the Disclosure

This disclosure relates generally to improvements to a connector of an electric or electronic circuit. More particularly the present disclosure relates to providing the connector with flexible edges.

Description of the Related Art

A connector is device used to join electrical terminals to complete an electric circuit. The connector is a female component that receives a plug forming a physical interface when connected. The connector can be fixedly or removably connected to the plug. A removable connector allows assembly and disassembly of the plug from the connector to replace a faulty connection (or plug) that can cause electrical or electronic failures. The connector has metal contacts (or other electrically conducting material) that contact with metal strips (or other electrically conducting material) of the plug establishing a metal-to-metal contact completing an electrical connection. An application of the connector and an electronic circuit board (plug) can be a LED lighting apparatus.

A conventional connector for an electronic circuit board or printed circuit board (PCB) is rigid that can cause assembly and metal-to-metal contact issues. For example, the connector may be partially assembled, but the LEDs can still light up, thus hiding the issue of partial connection. Furthermore, the partial connection may result in disassembly of the connector from the PCB due to vibration or other issues experienced during operation.

As such, a connector that can ensure complete connection with the PCB and that does not disassemble during use is needed. Such connectors are required to improve the efficiency of electrical circuits as well as improve the reliability of the devices implementing such connectors.

SUMMARY

According to an embodiment of the present disclosure, there is provided a connector. The connector includes a connector body having a top edge, a bottom edge and a wall connecting the top edge and the bottom edge, the wall providing flexibility to move the top edge relative to the bottom edge, a plurality of metal contacts embedded within the top edge and the bottom edge, and locking teeth projecting from the top edge and the bottom edge, wherein the top edge and the bottom edge move away from each other upon application of a force on the locking teeth.

The wall includes a notch at an outer portion of the wall for providing flexibility to the connector body. The notch stays open when no force is applied at the locking teeth. The notch closes as the top edge and the bottom edge move away from each other when the force is applied at the locking teeth.

The locking teeth are located at the ends of the top edge and the bottom edge. The height of the locking teeth is relatively greater than a height of the plurality of metal contacts projecting from the top edge and the bottom edge.

Furthermore, according to an embodiment of the present disclosure, there is provided an electric circuit. The electric circuit includes a connector and a printed circuit board. The connector includes a connector body having a top edge, a bottom edge and a wall connecting the top edge and the bottom edge, the wall providing flexibility to move the top edge relative to the bottom edge, a plurality of metal contacts embedded within the top edge and the bottom edge, and locking teeth projecting from the top edge and the bottom edge, wherein the top edge and the bottom edge move away from each other upon application of a force on the locking teeth.

The printed circuit board includes a plurality of pockets configured to receive the locking teeth of the connector and a plurality of metal strips configured to contact with the plurality of the metal contacts of the connector.

The wall includes a notch at an outer portion of the wall for providing flexibility to the connector body. The notch stays open when no force is applied at the locking teeth. The notch closes as the top edge and the bottom edge move away from each other when the force is applied at the locking teeth.

The locking teeth are located at the ends of the top edge and the bottom edge. The height of the locking teeth is relatively greater than a height of the plurality of metal contacts projecting from the top edge and the bottom edge. The printed circuit board pushes the locking teeth away from each other during assembly so as to prevent the plurality of metal strips from touching the plurality of metal contacts of the connector. The locking teeth are received in the plurality of pockets of the printed circuit board so that the plurality of metal strips touches the plurality of metal contacts of the connector to complete the assembly of the electric circuit.

Furthermore, according to an embodiment of the present disclosure, there is provided a lighting apparatus. The lighting apparatus includes a connector and a printed circuit board. The connector includes a connector body having a top edge, a bottom edge and a wall connecting the top edge and the bottom edge, the wall providing flexibility to move the top edge relative to the bottom edge, a plurality of metal contacts embedded within the top edge and the bottom edge, and locking teeth projecting from the top edge and the bottom edge, wherein the top edge and the bottom edge move away from each other upon application of a force on the locking teeth.

The printed circuit board includes a plurality of pockets configured to receive the locking teeth of the connector and a plurality of metal strips configured to contact with the plurality of the metal contacts of the connector.

The wall includes a notch at an outer portion of the wall for providing flexibility to the connector body. The notch stays open when no force is applied at the locking teeth. The notch closes as the top edge and the bottom edge move away from each other when the force is applied at the locking teeth. The notch closes as the top edge and the bottom edge move away from each other when the force is applied at the locking teeth.

The locking teeth are located at the ends of the top edge and the bottom edge. The height of the locking teeth is relatively greater than a height of the plurality of metal contacts projecting from the top edge and the bottom edge.

The forgoing general description of the illustrative implementations and the following detailed description thereof are merely exemplary aspects of the teachings of this disclosure, and are not restrictive.

BRIEF DESCRIPTION OF THE DRAWINGS

The accompanying drawings, which are incorporated in and constitute a part of the specification, illustrate one or more embodiments and, together with the description, explain these embodiments. The accompanying drawings have not necessarily been drawn to scale. Any values dimensions illustrated in the accompanying graphs and figures are for illustration purposes only and may or may not represent actual or preferred values or dimensions. Where applicable, some or all features may not be illustrated to assist in the description of underlying features. In the drawings.

DETAILED DESCRIPTION

The description set forth below in connection with the appended drawings is intended as a description of various embodiments of the disclosed subject matter and is not necessarily intended to represent the only embodiment(s). In certain instances, the description includes specific details for the purpose of providing an understanding of the disclosed embodiment(s). However, it will be apparent to those skilled in the art that the disclosed embodiment(s) may be practiced without those specific details. In some instances, well-known structures and components may be shown in block diagram form in order to avoid obscuring the concepts of the disclosed subject matter.

It is to be understood that terms such as "front," "rear," and the like that may be used herein merely describe points of reference and do not necessarily limit embodiments of the present disclosure to any particular orientation or configuration. Furthermore, terms such as "first," "second," "third," etc., merely identify one of a number of portions, components, and/or points of reference as disclosed herein, and likewise do not necessarily limit embodiments of the present disclosure to any particular configuration or orientation.

Furthermore, the terms "approximately," "proximate," "minor," and similar terms generally refer to ranges that include the identified value within a margin of 20%, 10% or preferably 5% in certain embodiments, and any values therebetween.

Figure 1A:
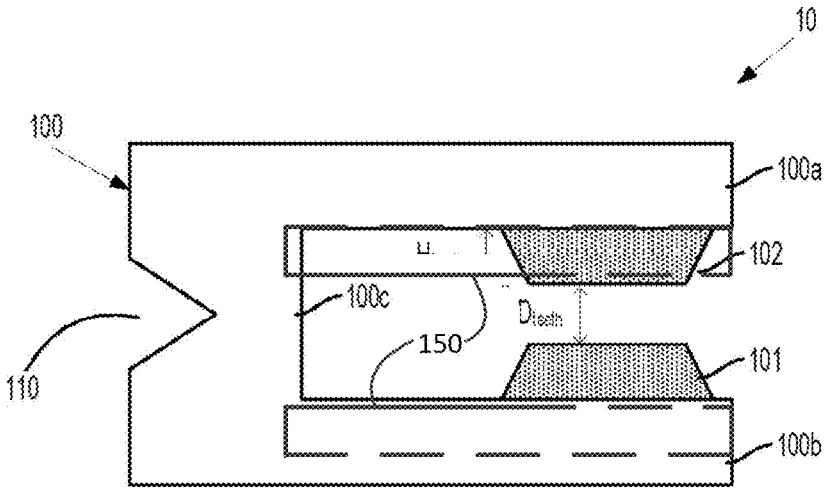
FIG. 1A is a side view of a connector according to an exemplary embodiment of the present disclosure.
Figure 1B:
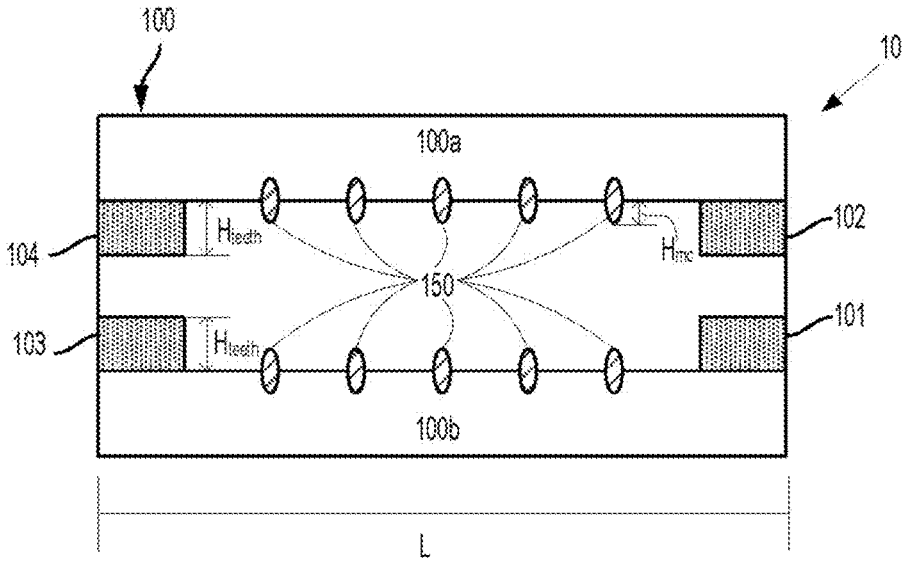
FIG. 1B is a front view of a connector according to an exemplary embodiment of the present disclosure.

FIGS. 1A and 1B illustrate a side view and a front view, respectively, of a connector 10 according to an exemplary embodiment of the present disclosure. The connector 10 includes a connector body 100 with a notch 110, a set of metal contacts 150 and a plurality of locking teeth 101, 102, 103, and 104. The connector body 100 houses the metal contacts 150 and the looking teeth 101-104.

The connector body 100 has a C-shape, approximately, and made of electrically non-conducting material such as plastic. The connector body 100 has a top edge 100*a* and a bottom edge 100*b*. The connector body 100 is formed such that the edges 100*a* and 100*b* can move relative to each other. For example, the connector body 100 can include a notch 110, or a pivot joint connecting the edges 100*a* and 100*b* that allows the top edge 100*a* to move relative to the bottom edge 100*b*. The top edge 100*a* and the bottom edge 100*b* can move away from each other when an upward force acts on the locking teeth 102 and 104 and/or a downward force acts on the locking teeth 101 and 103.

The connector body 100 includes the notch 110 on an outer side of a wall 100*c* connecting the top edge 100*a* and the bottom edge 100*b*. The notch 110 can be located approximately at a center of the wall 100*c* extending along the length L of the connector body 100. The notch 110 provides flexibility to the connector body 100 allowing the top edge 100*a* to move relative to the bottom edge 100*b*. Normally, the notch 110 can stay open; while the notch 110 can close as the top edge 100*a* and the bottom edge 100*b* move away from each other (as illustrated in FIG. 2A).

The metal contacts 150 are embedded along the length of the top edge 100*a* and the bottom edge 100*b* of the connector body 100. The metal contacts 150 can be made of any electrically conducting material such as copper, silver, gold, steel, etc. The metal contacts 150 also project outside the connector body 100 from the top edge 100*a* and the bottom edge 100*b*. The height $H_{mc}$ of the metal contacts 150 projecting outside the top edge 100*a* and the bottom edge 100*b* substantially similar.

The locking teeth 101-104 are protrusions projecting from ends of the top edge 100*a* and the bottom edge 100*b* extending in a similar direction as the metal contacts 150. The locking teeth 101-104 can be formed integrally with the top edge 100*a* and the bottom edge 100*b* during a molding process. The locking teeth 101-104 can be substantially rectangular in shape. The height $H_{teeth}$ of each of the locking teeth 101-104 can be substantially similar. Further, the height $H_{teeth}$ of each of the locking teeth 101-104 is greater than the height H. of the metal contacts 150. A distance $D_{teeth}$ between the locking teeth 101 (or 103) on the top edge 100*a* and the locking teeth 102 (or 104) on the bottom edge 100*b* is maintained to insert a male counterpart (e.g., a plug or PCB). The distance $D_{teeth}$ is slightly greater than or equal to the thickness of the PCB. Alternatively or in addition, the locking teeth 101-104 can have other appropriate geometric shapes (e.g., triangular, oval, or square).

Figure 2A:
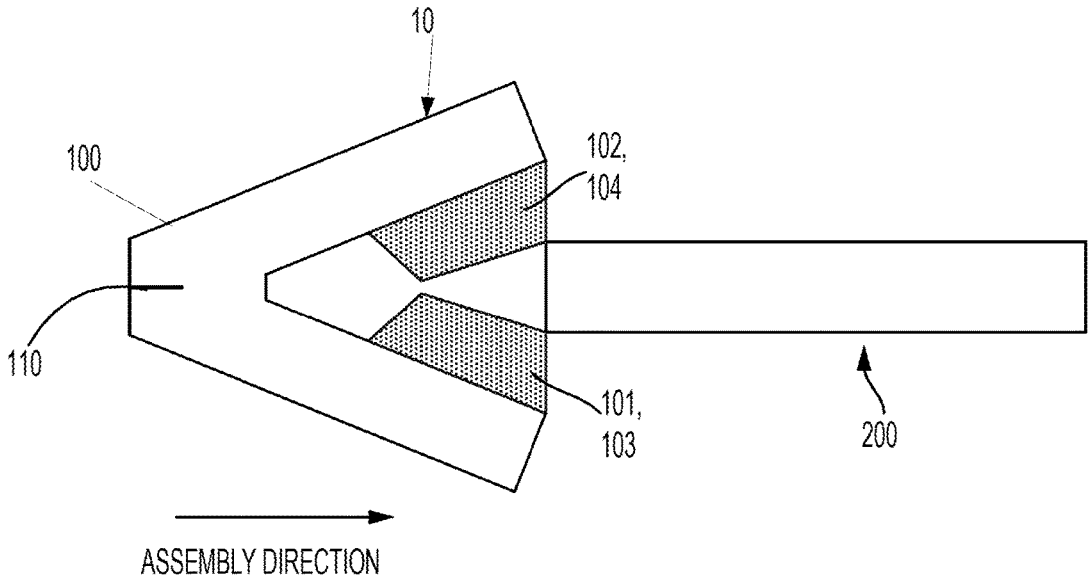
FIG. 2A illustrates a first configuration during an assembly of the connector with a printed circuit board according to an exemplary embodiment of the present disclosure.

During assembly of the connector 10 with a male counterpart (e.g., the plug or PCB), the locking teeth 101-104 prevent the metal contacts 150 from touching a metal strip of the male part (e.g., the PCB), further illustrated in FIG. 2A. Thus, the locking teeth 101-104 prevent any partial assembly of the connector 10. The locking teeth 101-104 ensure complete assembly of the connector 10 with the male counterpart (e.g., the PCB). The locking teeth 101-104 can also serve as a locking mechanism to lock the connector 10 to the male counterpart (e.g., the PCB). As such, the counterpart may not be disassembled due to vibration during operation.

FIG. 2A illustrates a first configuration during an assembly of the connector 10 with a printed circuit board 200 (referred as PCB 200 hereinafter) according to an exemplary embodiment of the present disclosure. During assembly, the PCB 200 is inserted from the open end of the connector body 100. As the PCB 200 slides inside the connector body 100, the PCB 200 causes the connector body 100 to flex closing the notch 110. As the connector body 100 flexes forming a V-shape, the metal contacts 150 (not illustrated) move away from the PCB 200, thus preventing metal contacts 150 from touching the PCB 200.

The PCB pushes the locking teeth 101-104 away from each other causing the top edge 100*a* and the bottom edge 100*b* of the connector body 100 to move away from each other. As such, the metal contacts 150 on the top edge 100*a* and the bottom edge 100*b* move away from the PCB 200. Further, as the height $H_{teeth}$ of each of the locking teeth 101-104 is greater than the height $H_{mc}$ of the metal contacts 150, the PCB 200 remains in contact with the locking teeth 101-104, but not with the metal contacts 150. Hence, the metal contacts 150 do not touch the PCB 200 and the electric circuit is not complete during the assembly. As such, partial assembly of the PCB 200 and the connector 10 can be avoided.

Figure 2B:
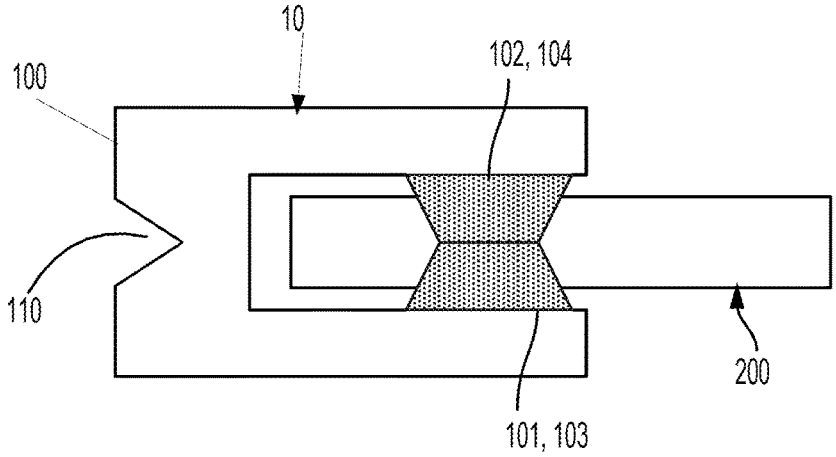
FIG. 2B illustrates a second configuration after assembly of the connector with the printed circuit board according to an exemplary embodiment of the present disclosure.

FIG. 2B illustrates a second configuration after assembly of the connector 10 with the PCB 200 according to an exemplary embodiment of the present disclosure. When the PCB 200 is fully inserted in the connector 10, the connector 10 flexes back to the original C-shape causing the metal contacts 150 to contact with the PCB 200. Furthermore, the locking teeth 101-104 sink in the PCB 200 locking the PCB 200 with the connector 10. An exemplary structure of the connector 10 and the PCB 200 that enable such assembly is illustrated in FIGS. 3 and 4.

Figure 3:
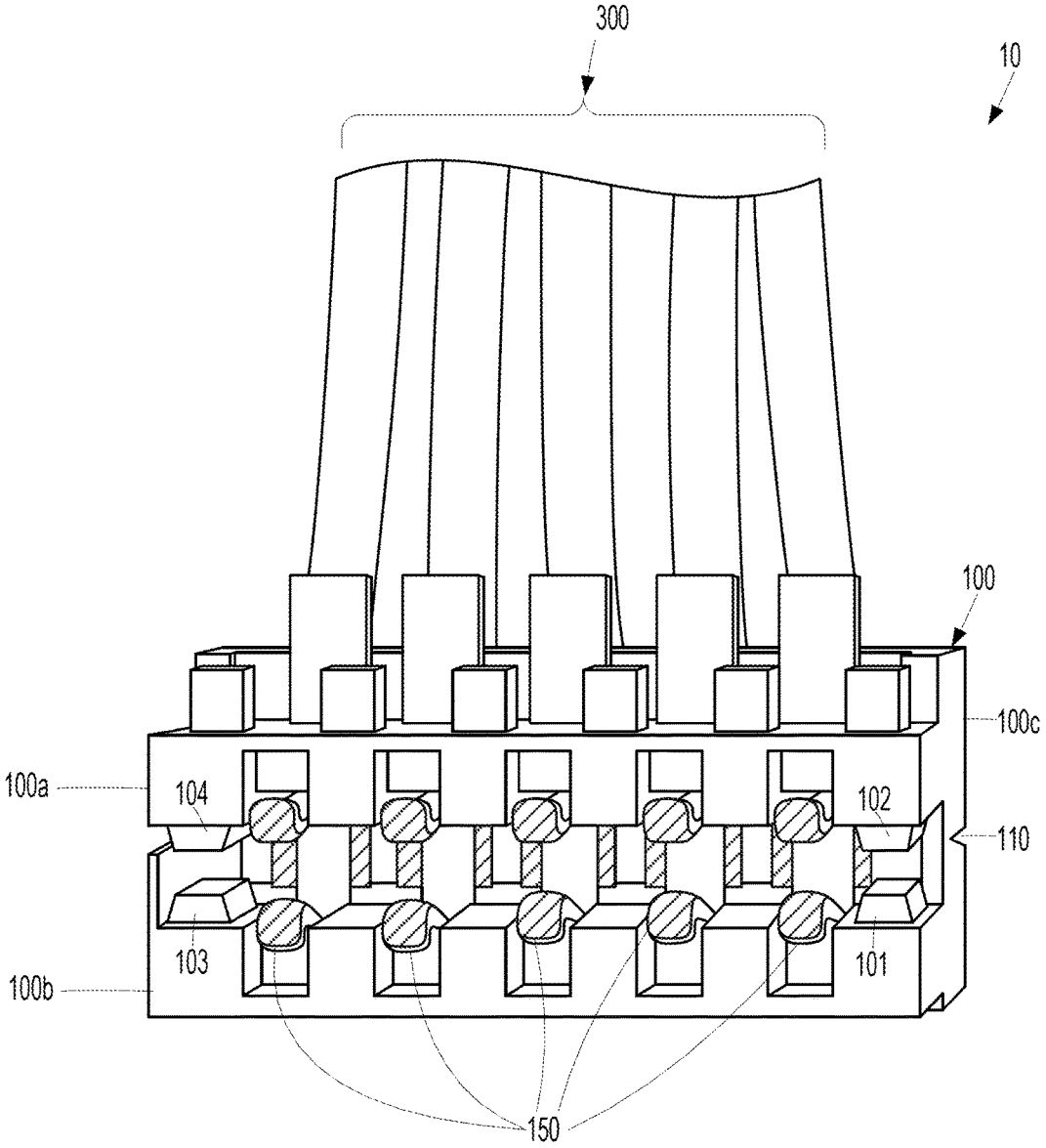
FIG. 3 illustrates the connector according to an exemplary embodiment of the present disclosure.

In FIG. 3, the connector 10 includes five metal contacts 150 on the top edge 100*a* and the bottom edge 100*b*, respectively. The metal contacts 150 are connected through the connector body 100. The connector 10 also includes electrical wires 300 connected to the metal contacts 150 through the wall 100*c*. At the ends (left and right) of the top edge 100*a*, the locking teeth 102 and 104 are formed. Similarly, at the ends (left and right) of the bottom edge 100*b*, the locking teeth 101 and 103 are formed. Alternatively or in addition, the locking teeth can be formed between the metal contacts 150.

Figure 4:
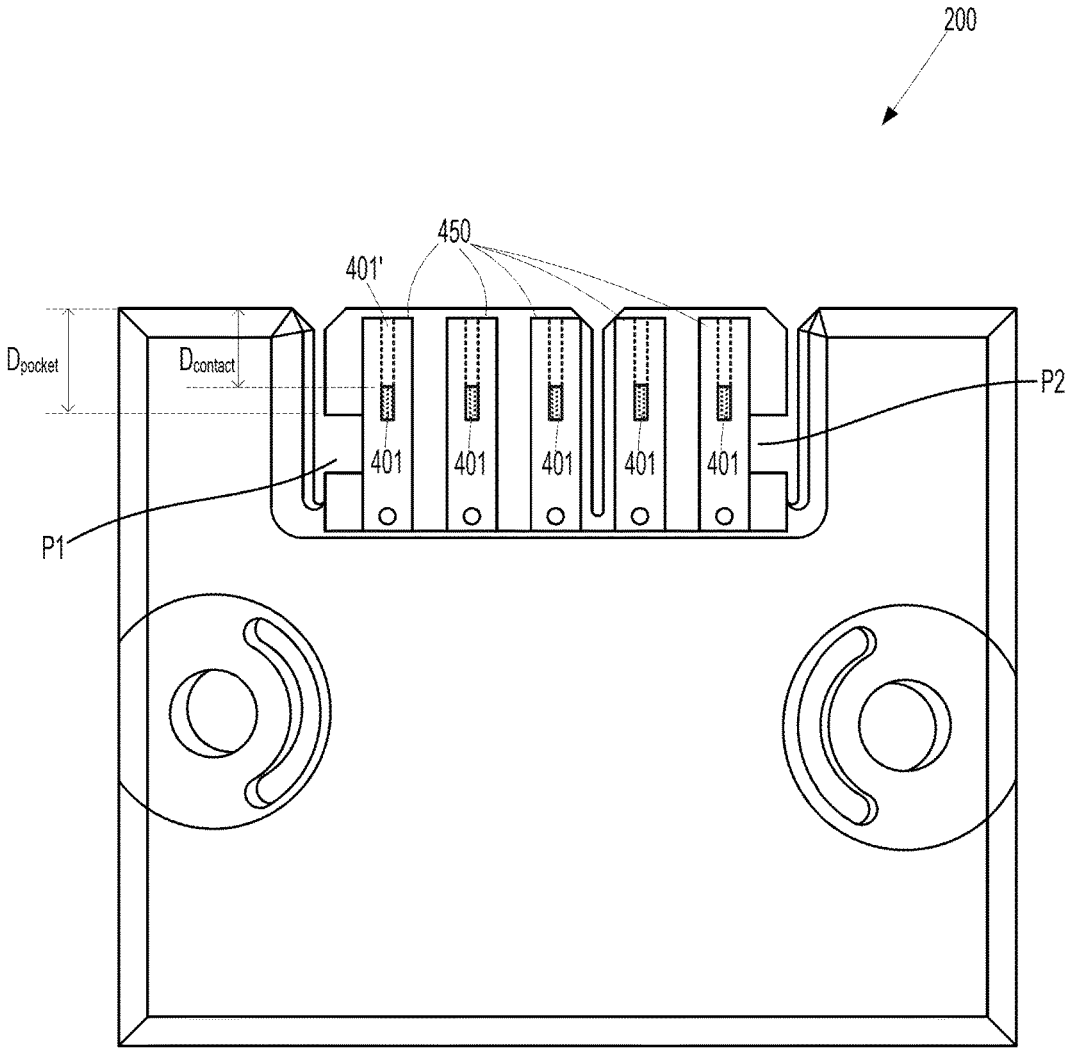
FIG. 4 illustrates the printed circuit board according to an exemplary embodiment of the present disclosure.
Figure 5:
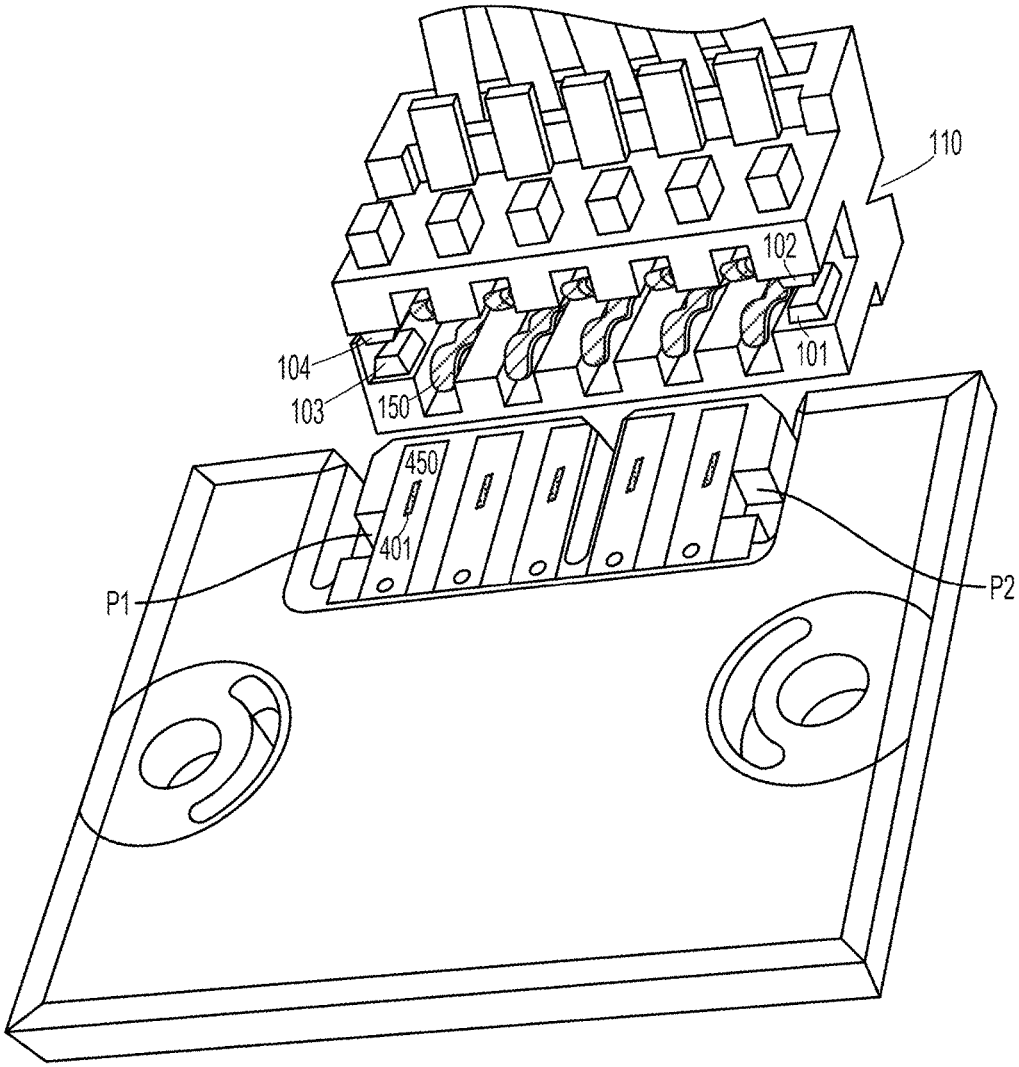
FIG. 5 illustrates an electric circuit having the connector and the printed circuit board according to an exemplary embodiment of the present disclosure.

FIG. 4 illustrates an example PCB 200 and FIG. 5 illustrates an electric circuit having the connector 10 and the PCB 200. In FIG. 5, the PCB 200 aligned with the connector 10 for assembling purpose to complete the electric circuit.

In FIGS. 4 and 5, the PCB 200 includes a plurality of metal strips 450 and a plurality of pockets P1 and P2. In one example, five metal strips 450 and two pockets P1 and P2 are illustrated. Upon assembly of the PCB 200 with the connector 10, the metal strips 450 contact with the metal contacts 150 of the connector 10. The metal contacts 150 touch the metal strips 450 at contact areas 401, thus completing the electric circuit. However, during assembly process, the metal strips 450 do not touch the metal contacts 150, thus preventing the completion of the electric circuit.

The contact areas 401 are located at a distance $D_{contact}$ from a top edge of the PCB 200. At the contact areas 401, the metal strips 450 wear out due friction from sliding of the metal contacts 150 on the metal strips 450. As the contact areas 401 start at the distance $D_{contact}$, the wear out of the metal strip is minimized.

The pockets P1 and P2 are formed at a distance $D_{pocket}$ from the top edge of the PCB 200. The shape and location of the pockets P1 and P2 correspond to and conform to the locking teeth 101-104 of the connector 10. The shape and location of the pockets P1 is such that the locking teeth 103 and 104 can sink in the pocket P1 and the locking teeth 101 and 102 sink in the pocket P2 upon complete assembly of the connector 10, as discussed earlier in the present disclosure. The distance $D_{pocket}$ of the pockets P1 and P2 is a function of complete assembly of the PCB 200 with the connector 10. Furthermore, the distance $D_{pocket}$ of the contact areas 401 is directly proportional to the distance $D_{pocket}$ of the pockets P1 and P2. As such, the longer the distance $D_{pocket}$, further the distance $D_{contact}$ where the contact areas 401 will be formed.

Conventionally, traditional contact areas 401' start from the top edge of the metal strips 450, as the metal contacts 150 slide along the metal strips 450. Hence, conventionally, the traditional contact areas 401' are longer than the contact areas 401. During assembly of PCB 200 with a conventional connector, the electric circuit can complete at any point along the traditional contact areas 401'. Thus, partial assembly of the PCB 200 with the conventional connector is highly likely. However, with the connector 10 partial assembly is unlikely, since the locking teeth 101-104 prevents metal-to-metal contact until complete assembly is done.

Figure 6:
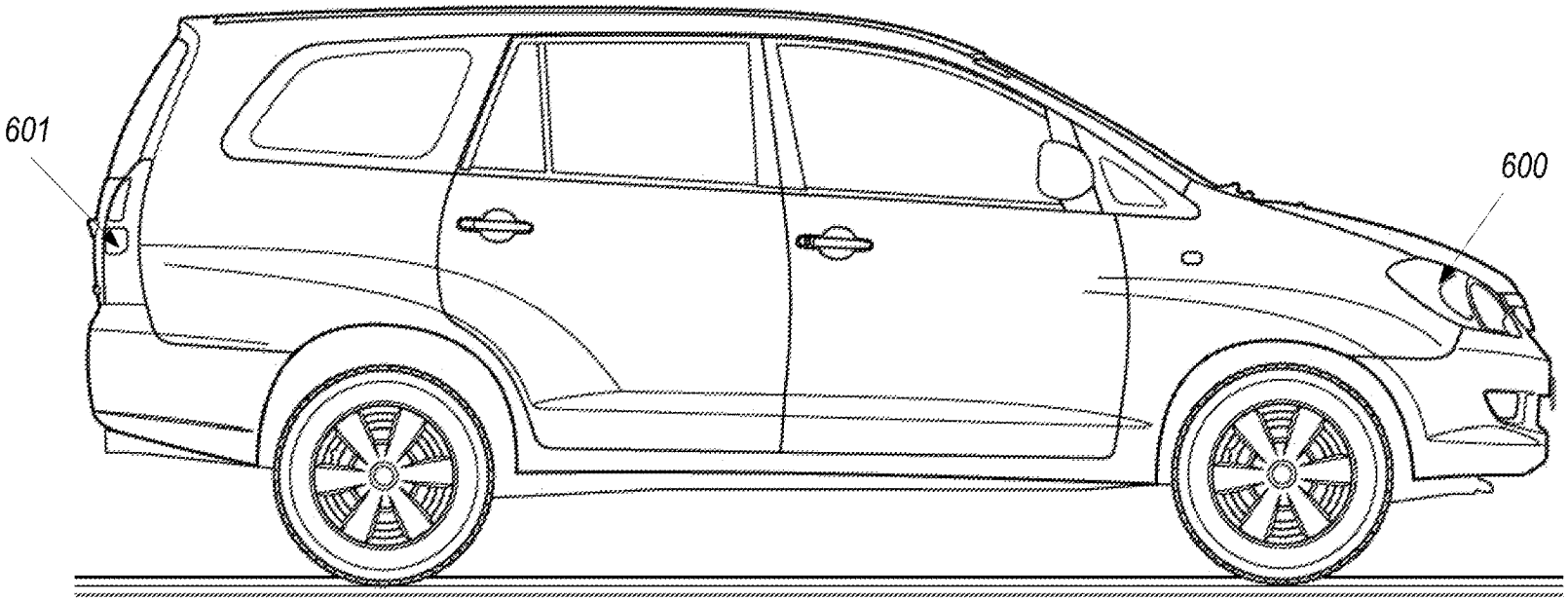
FIG. 6 illustrates a lighting apparatus of a vehicle according to an exemplary embodiment of the present disclosure.

FIG. 6 illustrates a lighting apparatus 600 of vehicle according to an embodiment of the present disclosure. The lighting apparatus 600 includes the connector 10 and the PCB 200. The lighting apparatus 600 can be a headlight, taillight 601, or other lighting apparatus installed on a vehicle. The PCB 200 can be a processing circuit configured to perform the lighting function of the vehicle such as turning the head light on or off, activating blinkers or turning lights, flashing the headlight 600, etc. Note that the lighting apparatus 600 is presented by way of example and is not limited to the lighting apparatus of a vehicle. The lighting apparatus 600 can be any other electric or electronic device that requires a PCB and a connector.

While certain embodiments have been described, these embodiments have been presented by way of example only, and are not intended to limit the scope of the present disclosures. Indeed, the novel apparatuses and systems described herein can be embodied in a variety of other forms; furthermore, various omissions, substitutions and changes in the form of the apparatuses and systems described herein can be made without departing from the spirit of the present disclosures. The accompanying claims and their equivalents are intended to cover such forms or modifications as would fall within the scope and spirit of the present disclosures.

What is claimed is:

1. A connector comprising:

a connector body having a top edge, a bottom edge and a wall connecting the top edge and the bottom edge, the wall being flexible including flexibility in a central region of the wall between attachments to the top edge and the bottom edge so as to allow movement of the top edge relative to the bottom edge;

a plurality of metal contacts embedded within the top edge and the bottom edge; and locking teeth projecting from the top edge and the bottom edge, wherein the top edge and the bottom edge move away from each other upon application of a force on the locking teeth.

2. The connector according to claim 1, wherein the wall includes a notch at an outer portion of the wall for providing flexibility to the connector body.

3. The connector according to claim 2, wherein the notch stays open when no force is applied at the locking teeth.

4. The connector according to claim 2, wherein the notch closes as the top edge and the bottom edge move away from each other when the force is applied at the locking teeth.

5. The connector according to claim 1, wherein the locking teeth are located at the ends of the top edge and the bottom edge.

6. The connector according to claim 1, wherein a height of the locking teeth is relatively greater than a height of the plurality of metal contacts projecting from the top edge and the bottom edge.

7. An electric circuit comprising:

a connector including a connector body having a top edge, a bottom edge and a wall connecting the top edge and the bottom edge, the wall being flexible including flexibility in a central region of the wall between attachments to the top edge and the bottom edge so as to allow movement of the top edge relative to the bottom edge, a plurality of metal contacts embedded within the top edge and the bottom edge, and locking teeth projecting from the top edge and the bottom edge, wherein the top edge and the bottom edge move away from each other upon application of a force on the locking teeth; and a printed circuit board including a plurality of pockets configured to receive the locking teeth of the connector and a plurality of metal strips configured to contact with the plurality of the metal contacts of the connector.

8. The electric circuit according to claim 7, wherein the wall includes a notch at an outer portion of the wall for providing flexibility to the connector body.

9. The electric circuit according to claim 8, wherein the notch stays open when no force is applied at the locking teeth.

10. The electric circuit according to claim 8, wherein the notch closes as the top edge and the bottom edge move away from each other when the force is applied at the locking teeth.

11. The electric circuit according to claim 7, wherein the locking teeth are located at the ends of the top edge and the bottom edge.

12. The electric circuit according to claim 7, wherein a height of the locking teeth is relatively greater than a height of the plurality of metal contacts projecting from the top edge and the bottom edge.

13. The electric circuit according to claim 12, wherein the printed circuit board pushes the locking teeth away from each other during assembly so as to prevent the plurality of metal strips from touching the plurality of metal contacts of the connector.

14. The electric circuit according to claim 12, wherein the locking teeth are received in the plurality of pockets of the printed circuit board so that the plurality of metal strips touch the plurality of metal contacts of the connector to complete the assembly of the electric circuit.

15. A lighting apparatus including comprising:

a connector including a connector body having a top edge, a bottom edge and a wall connecting the top edge and the bottom edge, the wall being flexible including flexibility in a central region of the wall between attachments to the top edge and the bottom edge so as to allow movement of the top edge relative to the bottom edge, a plurality of metal contacts embedded within the top edge and the bottom edge, and locking teeth projecting from the top edge and the bottom edge, wherein the top edge and the bottom edge move away from each other upon application of a force on the locking teeth; and a printed circuit board including a plurality of pockets configured to receive the locking teeth of the connector and a plurality of metal strips configured to contact with the plurality of the metal contacts of the connector.

16. The lighting apparatus according to claim 15, wherein the wall includes a notch at an outer portion of the wall for providing flexibility to the connector body.

17. The lighting apparatus according to claim 16, wherein the notch stays open when no force is applied at the locking teeth.

18. The lighting apparatus according to claim 16, wherein the notch closes as the top edge and the bottom edge move away from each other when the force is applied at the locking teeth.

19. The lighting apparatus according to claim 15, wherein the locking teeth are located at the ends of the top edge and the bottom edge.

20. The lighting apparatus according to claim 15, wherein a height of the locking teeth is relatively greater than a height of the plurality of metal contacts projecting from the top edge and the bottom edge.

* * * * *